US008844843B2

(12) United States Patent
Horiuchi et al.

(10) Patent No.: US 8,844,843 B2
(45) Date of Patent: Sep. 30, 2014

(54) SPRAY BUTTON

(75) Inventors: Shouhei Horiuchi, Yokohama (JP); Seiji Takahashi, Tokyo (JP); Mizuki Yamada, Tokyo (JP)

(73) Assignees: Toyo Seikan Kaisha, Ltd., Tokyo (JP); Toyo Aerosol Industry Co., Ltd., Tokyo (JP)

( * ) Notice: Subject to any disclaimer, the term of this patent is extended or adjusted under 35 U.S.C. 154(b) by 439 days.

(21) Appl. No.: 13/258,953

(22) PCT Filed: Mar. 30, 2010

(86) PCT No.: PCT/JP2010/055705

§ 371 (c)(1),
(2), (4) Date: Sep. 22, 2011

(87) PCT Pub. No.: WO2010/113947

PCT Pub. Date: Oct. 7, 2010

(65) Prior Publication Data

US 2012/0018539 A1 Jan. 26, 2012

(30) Foreign Application Priority Data

Mar. 31, 2009 (JP) ..... 2009-086745

(51) Int. Cl.
*B05B 1/34* (2006.01)
*B65D 83/20* (2006.01)

(52) U.S. Cl.
CPC ..... *B05B 1/3436* (2013.01); *B65D 83/20* (2013.01)
USPC ..... 239/469; 239/468; 239/490; 239/491; 239/492; 239/493

(58) Field of Classification Search
CPC .... B05B 1/341; B05B 1/3421; B05B 1/3426; B05B 1/3436
USPC ..... 239/463, 468, 469, 486, 490, 491, 492, 239/493, 518, 524
See application file for complete search history.

(56) References Cited

U.S. PATENT DOCUMENTS

| | | | | |
|---|---|---|---|---|
| 3,129,893 | A * | 4/1964 | Green | 239/490 |
| 4,071,196 | A * | 1/1978 | Burke et al. | 239/492 |
| 5,388,766 | A * | 2/1995 | Buisson | 239/333 |

(Continued)

FOREIGN PATENT DOCUMENTS

| | | | |
|---|---|---|---|
| JP | 2000-153188 | A | 6/2000 |
| JP | 2001-180770 | A | 7/2001 |
| JP | 2005-066588 | A | 3/2005 |
| JP | 2005-288221 | A | 10/2005 |

OTHER PUBLICATIONS

Notification of Transmittal of Translation of the International Preliminary Report on Patentability (Form PCT/IB/338) of International Application No. PCT/JP2010/055705 mailed Nov. 24, 2011 with forms PCT/IB/373 and PCT/ISA/237.

(Continued)

*Primary Examiner* — Ryan Reis
(74) *Attorney, Agent, or Firm* — Westerman, Hattori, Daniels & Adrian, LLP

(57) ABSTRACT

A spray button which is capable of spraying a content widely and decreasing the diameter of a sprayed particle. In the spray button comprising a spray button body and a nozzle body and having a rotation chamber, a spray orifice, and a plurality of spray grooves, assuming a diameter of the rotation chamber to be (D), a diameter of the spray orifice to be (Da), a width of a connection portion with the spray grooves and the rotation chamber to be (Dd), and a length from a stem-side sidewall of the nozzle body to a tip of the spray orifice to be (L), the relationships of D/Da>1, D/Dd≥5, D/L≥3 are satisfied.

4 Claims, 5 Drawing Sheets

(56) References Cited

U.S. PATENT DOCUMENTS

| | | | | |
|---|---|---|---|---|
| 7,886,995 | B2 * | 2/2011 | Togashi | 239/463 |
| 2009/0057447 | A1 * | 3/2009 | Lowry et al. | 239/601 |

OTHER PUBLICATIONS

International Search Report of PCT/JP2010/055705, mailing date Jun. 1, 2010.

* cited by examiner

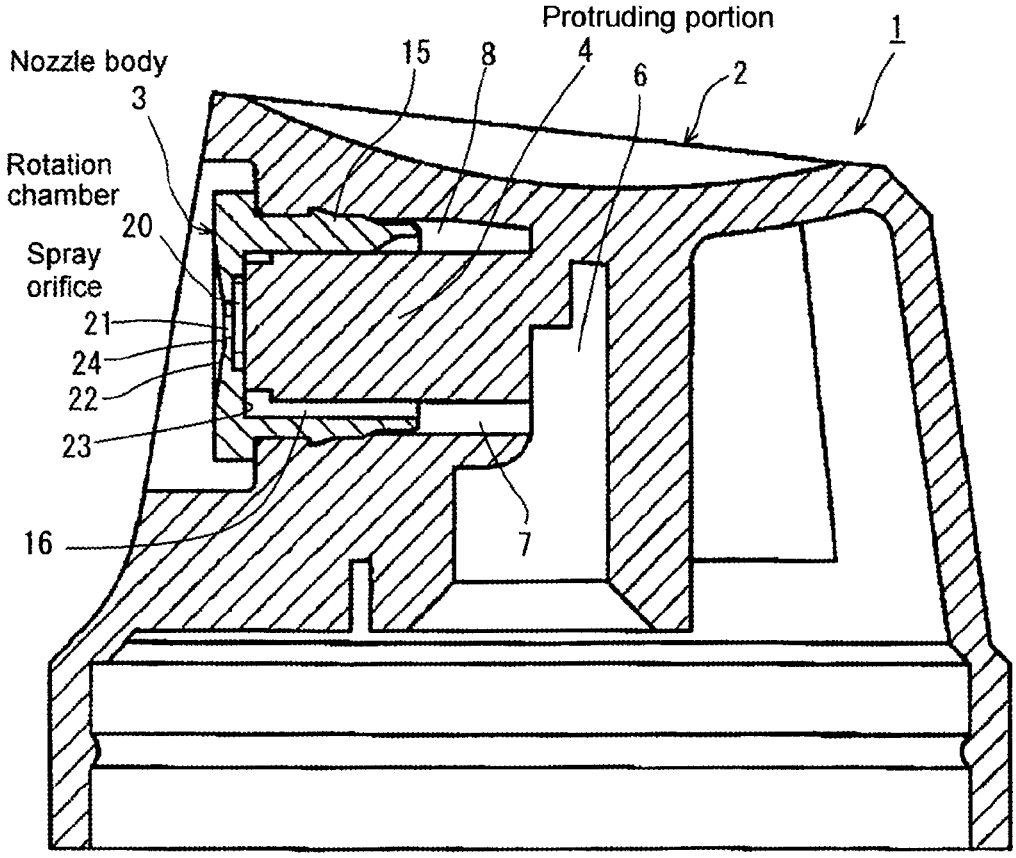
FIG. 1
FIG. 2
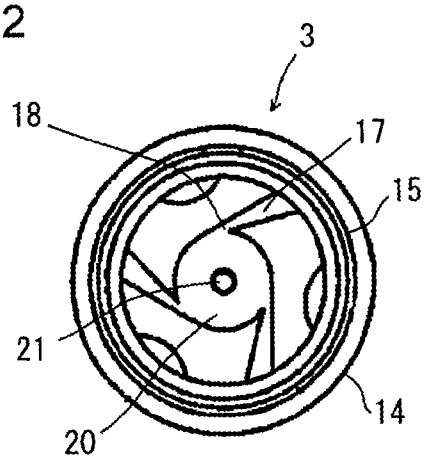

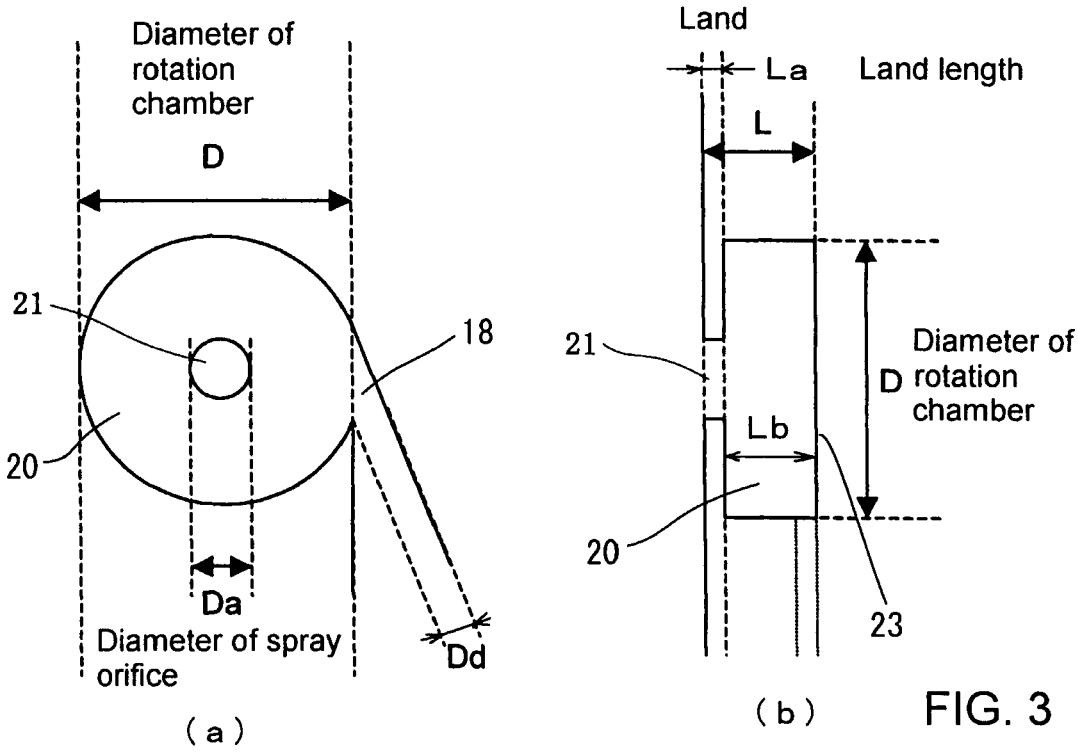
FIG. 3
FIG. 4
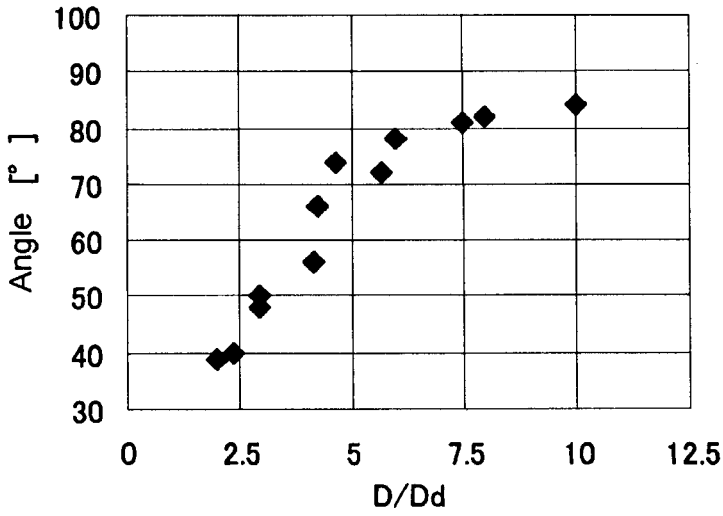

SPRAY BUTTON

TECHNICAL FIELD

The present invention relates to a spray button that sprays a content, and more particularly to a spray button of a mechanical breakup system which is mounted on an aerosol container and sprays the aerosol content.

BACKGROUND ART

Mechanical breakup buttons have been used as spray buttons meeting the requirements for reduced diameter of sprayed particles of aerosol content and for spraying of the content in a wide range. Such a mechanical breakup button is known as a mechanism in which a rotational force is imparted to the content in the vicinity of a spray orifice and the content is sprayed from the spray orifice, thereby spraying fine and uniform particles. This type of mechanical breakup button is particularly effective when the spraying agent is a compressed gas. A known example of conventional mechanical breakup buttons is the one in which a variety of measures are taken such that a tip inserted into the depression of the spray button is provided and a spraying liquid passage is formed in the circumferential surface of the tip, thereby the content is sprayed at a wide angle from the spray orifice while being rotated, from a groove formed in the front end of the tip or the inner surface of the nozzle body via the rotation chamber (see, for example, Patent Documents 1 and 2).

PRIOR ART DOCUMENTS

Patent Documents

Patent Document 1: Japanese Patent Application Publication No. 2001-180770.

Patent Document 2: Japanese Patent Application Publication No. 2000-153188.

DISCLOSURE OF THE INVENTION

Problems to be Resolved by the Invention

As mentioned hereinabove, the spray buttons of the mechanical breakup system are effective for wide-angle spraying, but in the conventional spray buttons, only a spraying angle of equal to or less than 80°, at maximum 90°, could be realized. Therefore, in the conventional spraying in which the content such as hair cosmetic products, e.g. hair spray, garden insecticides, and deodorants for garbage is sprayed by using compressed gas or liquefied gas, a wider spraying angle and finer particles are required to demonstrate good coating effect, but this requirement has not yet been satisfied.

Accordingly, it is an object of the present invention to provide a spray button that can spray the content in a wide range at a wide angle, can reduce the diameter of sprayed particles, and has a simple structure.

Means for Resolving the Problems in order to clarify why the spray button of the conventional mechanical breakup system is unable to spray at an angle larger than 80° to 90°, the inventors focused attention on the diameter Da of the spray orifice, diameter D of the rotation chamber, length L from the stem-side sidewall of the nozzle body to the tip of the spray orifice, land length La of the spray orifice, thickness Lb of the rotation chamber, width Dd of the spray groove, depth of the spray groove, and the number of spray grooves, among the dimensions of the spray button configuration schematically shown in FIG. 3, presupposed that three factors, namely, the ratio D/Da of the diameter D of the rotation chamber to the diameter Da of the spray orifice, the ratio D/Dd of the diameter D of the rotation chamber to the width Dd of the spray groove, and the ratio D/L of the diameter D of the rotation chamber to the distance L from the stem-side sidewall of the nozzle body to the tip of the spray orifice, produce a particularly strong effect on the spraying angle and particle diameter of the content, and analyzed by numerical analysis the effect produced by these values on the spraying angle.

The graph shown in FIG. 4 is obtained by numerical analysis of the effect produced by the ratio D/Dd of the diameter D of the rotation chamber to the width Dd of the spray groove on the spraying angle. In this case, the dimensions other than the diameter D of the rotation chamber and the width Dd of the spray groove were fixed and the spraying angle was determined by changing the diameter D of the rotation chamber and the width Dd of the spray groove, thereby changing the D/Dd ratio. As a result, it was found that wide-angle spraying is performed when the D/Dd value is large. Further, the graph shown in FIG. 5 is obtained by numerical analysis of the effect produced on the spraying angle when the dimensions other than the diameter D of the rotation chamber and the distance L from the stem-side sidewall of the nozzle body to the tip of the spray orifice are fixed and the D/L value is changed. In this case, it was found that wide-angle spraying is performed when the D/L value is large. Further, FIG. 6 shows the results obtained when the effect produced by the land length La on the spraying angle was numerically analyzed with respect to the case in which the dimensions other than the land length La were fixed. It was found that wide-angle spraying is performed when the land length La is shorter. Thus, the spraying angle increases as the land length La comes close to 0 mm. Further, FIG. 7 shows the results obtained when the effect produced by the width Dd of the spray groove on the spraying angle was numerically analyzed with respect to the case in which the dimensions other than the width Dd of the spray groove were fixed. It was found that that wide-angle spraying is performed when the width of the spray groove is small.

Tests repeatedly conducted in parallel with the aforementioned numerical analysis, demonstrated that spraying can be performed at a spraying angle of equal to or greater than 90° and the particle diameter of the content can be decreased by combining the dimensions so as to satisfy the predetermined conditions. This finding led to the creation of the present invention.

Thus, the spray button according to the invention as in claim 1, which resolves the abovementioned problems, has a rotation chamber, a spray orifice, and a plurality of spray grooves, wherein when a diameter of the rotation chamber is denoted by D, a diameter of the spray orifice is denoted by Da, a width of a connection portion of each of the spray grooves and the rotation chamber is denoted by Dd, and a length from a stem-side sidewall of a nozzle body to a tip of the spray orifice is denoted by L, the following relationships are satisfied:

$$D/Da > 1; \quad \text{(i)}$$

$$D/Dd \geq 5; \quad \text{(ii)}$$

and $$D/L \geq 3 \quad \text{(iii)}.$$

Under the abovementioned conditions, when the diameter of the rotation chamber is equal to or less than the diameter of the spray orifice, that is, when D/Da≤1, it is difficult to generate rotation in the contents and wide-angle spraying is impossible. Accordingly, D/Da>1, desirably D/Da≥3. Further, when D/Dd<5, sufficient rotation cannot be provided to the contents in the rotation chamber and therefore wide-angle spraying is impossible and fine atomization cannot be performed. Therefore, D/Dd≥5. As for the relationship with D/L, when the length L from the stem-side sidewall to the tip of the spray orifice is larger than the diameter of the rotation chamber, flow resistance of the contents becomes large, and spraying without rotation is performed. Therefore, the condition D/L≥3 should be satisfied to attain a spraying angle of equal to or greater than 90°.

In addition to the abovementioned conditions, it is desirable that the spray button in accordance with the present invention satisfy the following conditions: the land length of the spray orifice is equal to or less than 0.3 mm, the length from the stem-side sidewall of the rotation chamber to the tip of the spray orifice is equal to or less 0.6 mm, the diameter of the rotation chamber is 1.5 mm to 3.0 mm, and the width of the connection portion of each of the spray grooves and the rotation chamber is 0.1 mm to 0.3 mm. Further, it is desirable that the number of spray grooves be equal to or greater than three. The spray button can be advantageously used in a container in which spraying is performed with a compressed gas.

Effects of the Invention

With the above-described configuration, the present invention demonstrates the following exceptional effects: the content can be sprayed at a wide angle of equal to or greater than 90° that could not be heretofore attained, the diameter of sprayed particles can be reduced, and the structure can be simplified.

BRIEF DESCRIPTION OF THE DRAWINGS

FIG. 1 is a front sectional schematic view of the spray button according to an embodiment of the present invention.

FIG. 2 is a side view taken from the stem side of the nozzle body.

FIG. 3 is a schematic diagram illustrating the dimensional relationship of the nozzle body. FIG. 3(*a*) is a schematic view of the side surface taken from the stem side. FIG. 3(*b*) is a front sectional schematic view.

FIG. 4 is a graph showing the relationship between the ratio of the diameter D of the rotation chamber to the width Dd of the spray groove and the spraying angle, this relationship being obtained by numerical analysis.

BEST MODE FOR CARRYING OUT THE INVENTION

Figure 5:
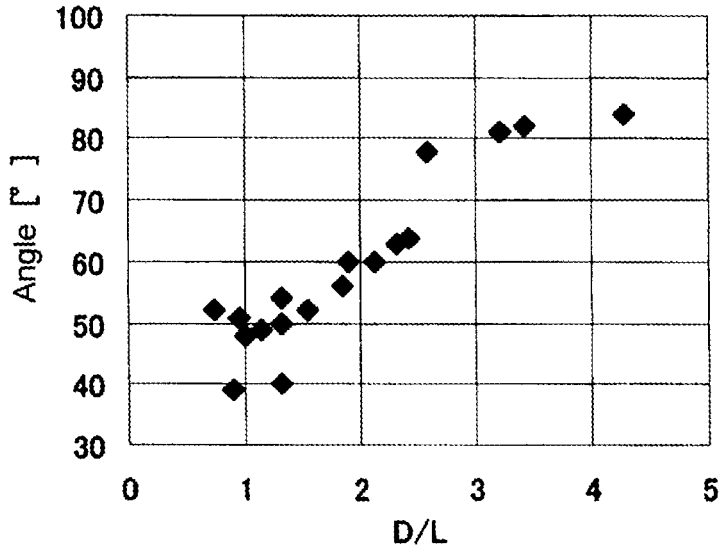
FIG. 5 is a graph showing the relationship between the ratio of the diameter D of the rotation chamber to the length L from the stem-side sidewall to the tip of the spray orifice and the spraying angle, this relationship being obtained by numerical analysis.
Figure 6:
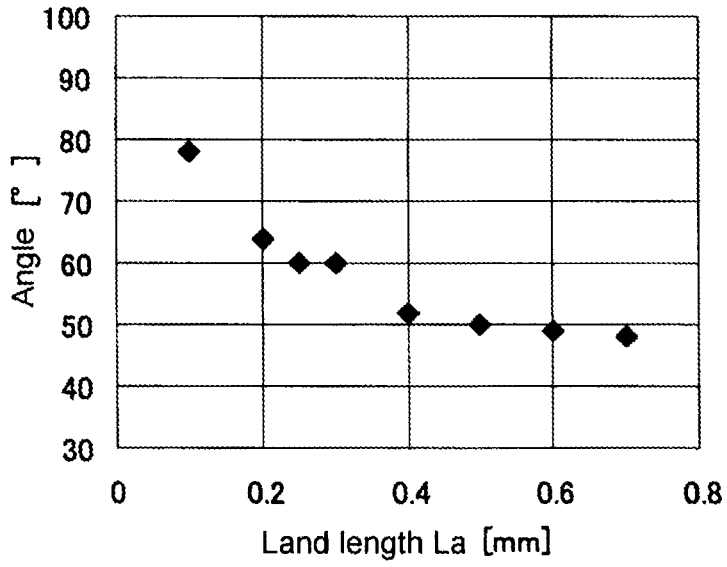
FIG. 6 is a graph showing the relationship between the length La from the land and the spraying angle, this relationship being obtained by numerical analysis.
Figure 7:
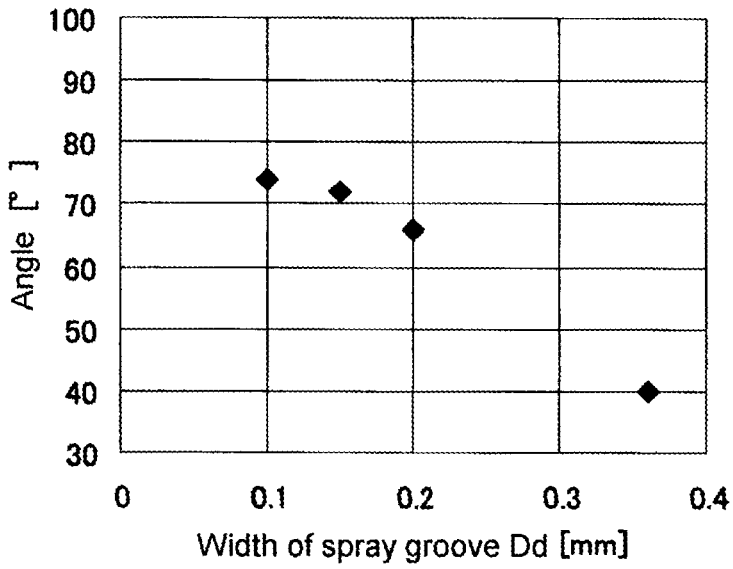
FIG. 7 is a graph showing the relationship between the width Dd of the spray groove and the spraying angle, this relationship being obtained by numerical analysis.

Embodiments of the spray button in accordance with the present invention will be described below in greater detail with reference to the appended drawings.

FIG. 1 is a front sectional schematic view of the spray button according to an embodiment of the present invention. The spray button 1 according to the present embodiment is a two-piece assembly including a spray button body 2 and a nozzle body 3, and the spray button is assembled with the nozzle body 3 fitted to a protruding portion 4 of the spray button body 2. The spray button body 2 is molded integrally from a synthetic resin and has formed inside the central portion thereof an inflow channel 6 for inserting a container stem. A leading hole 7 is formed in a direction substantially orthogonal to the inflow channel 6. An annular groove 8 for inserting an annular wall 15 of the nozzle body 3 is formed between the outer circumferential section of the protruding portion 4 and the spray button body 2. As described hereinbelow, the annular groove serves as a spray flow channel for the contents and communicates with a rotation groove formed between the annular groove and the nozzle body.

The nozzle body 3 is constituted by a nozzle base 14 and the annular wall 15 formed in a protruding condition on the rear surface (stem side) of the nozzle base. As shown in FIG. 1, the annular wall 15 is formed to a length such as to be inserted to the intermediate section of the annular groove 8. A plurality (three in the embodiments shown in the figure) passages 16 are equidistantly formed along the outer circumferential surface of the protruding portion 4 in the inner circumferential surface of the annular wall 15, and the proximal end portions thereof communicate with a spray groove 17 formed in a stem-side sidewall 23 of the nozzle body. The spray groove 17 is formed so as to be in contact, from a substantially tangential direction, with the outer circumferential portion of the below-described rotation chamber 20. The content is supplied in the tangential direction (in the present embodiment, from three sides) into the rotation chamber 20, and a swirling flow is formed in the rotation chamber. As shown in FIG. 2, the spray groove 17 is formed so as to decrease in width with a transition to the connection portion 18 of the rotation chamber. In the present embodiment, the spray groove 17 is formed in the stem-side sidewall 23 of the nozzle body, but can be also formed in a distal end surface of the protruding portion 4 of the spray button body.

The rotation chamber 20 is formed as a round depression in the rear surface of the nozzle base and formed between the spray button body and the distal end surface of the protruding portion 4 of the spray button body 2. In the present embodiment, the rotation chamber is formed as a round depression, but it may be also formed as a dome-shaped or conical depression. A spray orifice 21 is formed from the central portion of the rotation chamber 20 through the nozzle base 14. In the present embodiment, as shown in FIG. 1, the spray orifice 21 forms a dome-shaped depression 22 in the surface of the nozzle base, the center of the bottom portion thereof is opened, and good wide-angle spraying of the content is enabled.

The spray button according to the present embodiment has the above-described structure, and where the spray button is mounted on a stem of a container (not shown in the figure), and pushed down to push the stem down, a valve opens, the content is pushed from the inflow channel 6 through the annular groove 8 by the pressure of pressurized gas, liquefied gas, or trigger-type pump, and the content flows from the distal end of the groove into the rotation chamber from tangential directions at three positions spaced by 120° via the liquid passage 16 formed in the inner circumferential surface of the annular wall. Since the content flows into the rotation chamber from three tangential directions under a high pressure, a strong swirling flow is formed in the rotation chamber, and the content is sprayed to the outside from the spray orifice 21, while maintaining the rotation. In this case, the content is pulverized into fine particles in the rotation process and sprayed at a predetermined spraying angle.

In the present embodiment, as shown schematically in FIG. 3, the spray button of the above-described structure is formed such that when a diameter of the rotation chamber 20 is denoted by D, a diameter of the spray orifice 21 is denoted by Da, a width of the connection portion 18 of the spray groove and the rotation chamber is denoted by Dd, and a length from the stem-side sidewall 23 to the tip 24 of the spray orifice is denoted by L, the following relationships are satisfied: $D/Da>1$, $D/Dd\geq5$, and $D/L\geq3$. Further, the spray button is formed such that the land length La of the spray orifice 21 is equal to or less than 0.3 mm, the length L from the stem-side sidewall surface 23 of the rotation chamber 20 to the tip surface 24 of the spray orifice is equal to or less than 0.6 mm, the diameter D of the rotation chamber is 1.5 mm to 3.0 mm, and the width of the connection portion 18 of the spray groove 17 and the rotation chamber 20 is within a range of 0.1 mm to 0.3 mm.

The land length La is preferably small so that no flow rate resistance acts during spraying on the content rotated in the rotation chamber, but when the land length is less than 0.1 mm, the configuration lacks endurance. Therefore, the desired range is from 0.1 mm to 0.3 mm. The inventors have conducted a test and performed a numerical analysis by changing the land length La within a range of 0.2 to 0.7. In the below-described examples, a spraying angle of equal to or greater than 90° has been realized at a land length of 0.2 mm, but within a land length range of 0.3 mm to 0.7, only a spraying angle within a range of 48° to 80° could be obtained.

Similarly to the case of the land length La, in order to reduce the flow resistance of the swirling flow, it is preferred that the length L from the stem-side sidewall surface 23 of the rotation chamber 20 to the dip surface 24 of the spray orifice be as small as possible, desirably equal to or less than 0.6 mm, but with consideration for the strength of the spray orifice 21 and the formation length of the rotation chamber, a range of 0.3 mm to 0.6 is desirable. Likewise, the numerical calculations and tests demonstrate that a good spraying angle could not be obtained within an L range of 0.65 mm to 1.15 mm.

From the standpoint of forming a swirling flow, a large diameter D of the rotation chamber is desirable, but when this diameter is large, the diameter of the nozzle body should be increased. Therefore, a range of 1.5 mm to 3.0 mm is desirable. When the diameter D of the rotation chamber is equal to or less than 1.5 mm, a strong swirling flow is difficult to be formed and wide-angle spraying cannot be performed. Further, it is desirable that the width of the connection portion of the spray groove and the rotation chamber be 0.1 mm to 0.3 mm. As described hereinabove, there is the relationship between the width of the connection portion and the diameter of the rotation chamber that makes it possible to obtain good spraying, and when the diameter of the rotation chamber is 1.5 mm to 3.0 mm, the width of the connection portion is desirably within a range of 0.1 mm to 0.3 mm. Further, in order to generate uniform high-speed swirls in the content in the rotation chamber 20, it is desirable that the number of spray grooves be equal to or more than three.

The spray button according to the present embodiment can be used with containers for spraying various contents, in particular with aerosol containers in which spraying is performed by compressed gas. Nitrogen, carbon dioxide, and nitrogen suboxide can be used as the compressed gas. As for the content, the spray button can be advantageously used for spraying aerosol content with a viscosity of equal to or less than 100 cp. Such contents can be sprayed at a wide angle of equal to or greater than 90° and with an average particle diameter of equal to or less than 65 μm. Therefore, the spray button can be used for spraying aerosol content on water or alcohol base, such as hair cosmetic products, e.g. hair spray, garden insecticides, and deodorants for garbage, enables spraying in a fine-particle state and a range wider than that of the conventional spray buttons, and excels in a coating effect.

EXAMPLES

The spray buttons of Example 1 and Example 2 that have the structure shown in FIG. 1 are configured such that the diameter Da of the spray orifice, the D of the rotation chamber, the length L from the stem-side sidewall to the tip of the spray orifice, the land length La, the thickness Lb of the rotation chamber, the width Dd of the spray groove, the depth of the spray groove, and the number of spray grooves have dimensions shown in Table 1. Water with a viscosity of 1 cp was sprayed as aerosol content with nitrogen under a pressure of 0.7 MPa as a compressed gas. The spraying angle and the average particle diameter were measured. The spraying angle was measured from the image picked up at the instant of spraying.

The average particle diameter was measured with a particle size distribution measurement apparatus of a laser diffraction system at a distance from the measurement point to the spray orifice at 15 cm. The results are shown in Table 1.

In Comparative Examples 1 to 4, spraying was conducted under conditions similar to those of the examples by using commercially available spray buttons #1 to #4 of a mechanical breakup system, and the spraying angle and average particle diameter were measured. The dimensions in the comparative examples are actually measured values. The results obtained in comparative examples are shown together with those obtained in the examples in Table 1.

TABLE 1

| | Comparative Example 1 | Comparative Example 2 | Comparative Example 3 | Comparative Example 4 | Example 1 | Example 2 |
|---|---|---|---|---|---|---|
| | Spray button No. | | | | | |
| | #1 | #2 | #3 | #4 | #5 | #6 |
| Diameter of spray orifice, Da[mm] | 0.4 | 0.36 | 0.43 | 0.25 | 0.4 | 0.4 |
| Diameter of rotation chamber, D [mm] | 0.85 | 1.5 | 0.85 | 1.5 | 1.5 | 2.1 |
| Length, L [mm] | 0.9 | 0.53 | 0.8 | 0.89 | 0.45 | 0.45 |
| Land length, La [mm] | 0.5 | 0.36 | 0.2 | 0.2 | 0.2 | 0.2 |
| Thickness of rotation chamber, Lb [mm] | 0.4 | 0.17 | 0.6 | 0.69 | 0.25 | 0.25 |
| Width of spray groove, Dd [mm] | 0.29 | 0.16 | 0.3 | 0.27 | 0.2 | 0.2 |
| Depth of spray groove, [mm] | 0.4 | 0.17 | 0.4 | 0.21 | 0.25 | 0.25 |
| Number of spray grooves | 4 | 4 | 4 | 2 | 3 | 3 |
| Spraying angle, [°] | 40 | 80 | 62 | 61 | 90 | 95 |
| Average particle diameter, [μm] | 85 | 63 | 73 | 64 | 65 | 64 |

Figure 8:
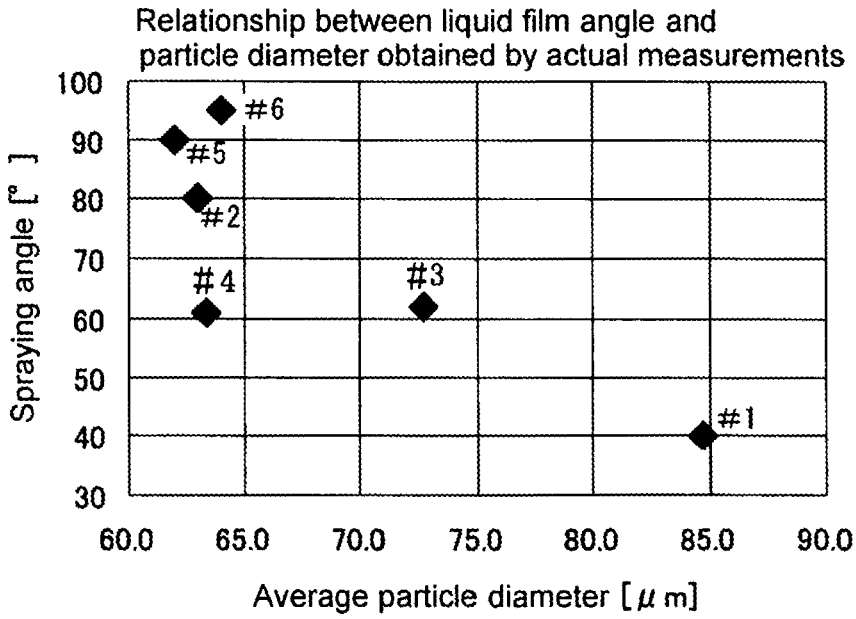
FIG. 8 is a graph showing the relationship between the spray angle and the particle diameter based on actual measurements conducted in examples and comparative examples.

Among the results shown in Table 1, the spraying angle and average particle diameter in Examples 1 and 2 and Comparative Examples 1 to 4 are shown in the graph in FIG. 8. As obvious from Table 1 and FIG. 8, in Example 1 and Example 2 wide-angle spraying (spraying angle is equal to or greater than 90°) was possible at a spraying angle of 90° and 95°, respectively, whereas in the comparative examples a spraying angle of only 80° to 40°, with the maximum value of the spraying angle being 80° in Comparative Example 2, was obtained. As for the average particle diameter of the aerosol content, good fine particles of approximately the same size were obtained in Example 1 (65 μm), Example 2 (64 μm), Comparative Example 2 (63 μm), and Comparative Example 4 (64 μm)).

The above-described examples have clearly confirmed that the spray button in accordance with the present invention makes it possible to obtain wide-angle spraying, which cannot be attained with the conventional spray buttons, and a sufficiently small diameter of sprayed particles and demonstrates a high coating effect.

Figure 9:
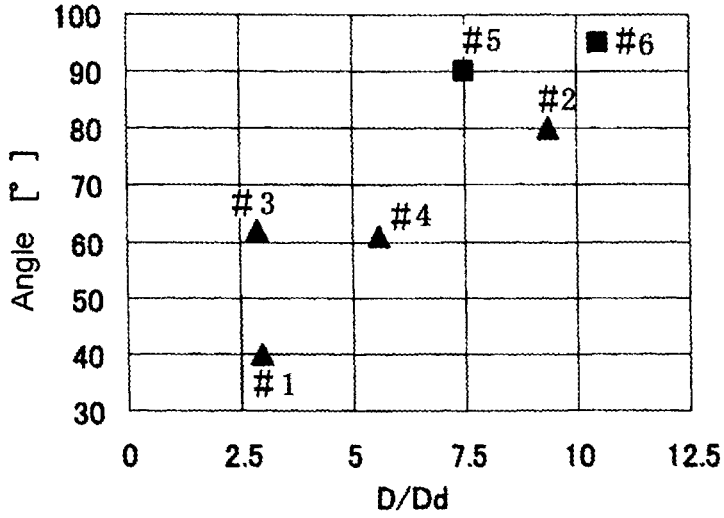
FIG. 9 is a graph illustrating the relationship between the ratio of the diameter D of the rotation chamber to the width Dd of the spray groove and the spraying angle in examples and comparative examples.

The abovementioned results were further analyzed and the effect produced by the ratio D/Dd of the diameter D of the spray groove to the width Dd of the connection portion of the rotation chamber on spraying angle in the examples and comparative example was studied. The results obtained are shown in the graph in FIG. 9. Similarly to the numerical analysis results, these results demonstrate that the spraying angle increases with the increase in D/Dd in the examples and comparative examples. However, in Example 1 a spraying angle of 90° is obtained at a D/Dd of 7.5 and in Example 2 a spraying angle of 95° is obtained at D/Dd=10.5, whereas in Comparative Example 2, a spraying angle of 80° is obtained at D/Dd=9.37 and in Comparative Example 3, a spraying angle of only 63° is obtained at D/Dd=2.83.

Figure 10:
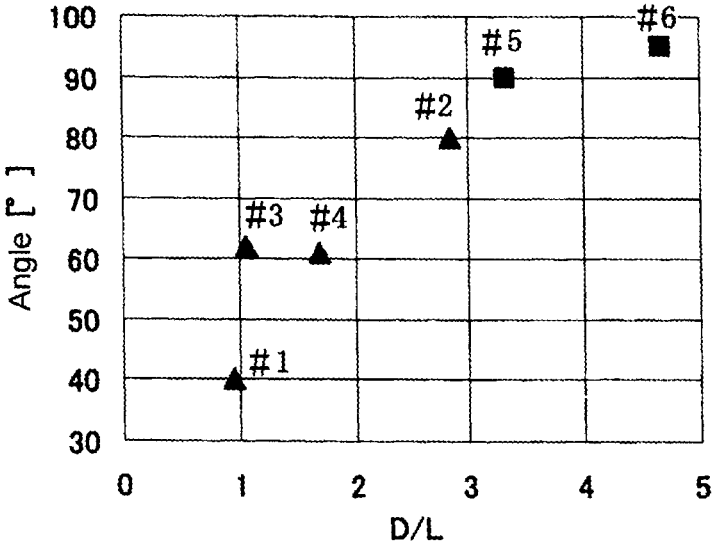
FIG. 10 is a graph showing the relationship between the ratio of the diameter D of the rotation chamber to the length L from the stem-side sidewall to the tip of the spray orifice and the spraying angle in examples and comparative examples.

The effect produced by the ratio D/L of the diameter D of the rotation chamber to the length L from the stem-side side wall surface to the tip of the spray orifice on the spraying angle was similarly studied. The results are shown in the graph in FIG. 10. Similarly to the numerical analysis results, the graph demonstrates that the spraying angle increases with the increase in D/L in the examples and comparative examples. In Example 1 and Example 2, a spraying angle of 90° and 95° is attained by setting D/L=3.33 and D/L=4.6, respectively. By contrast, in Comparative Example 2 and Comparative Example 3, D/L=2.8 and D/L=1.06, respectively, and only a spraying angle of 80° and 63° was obtained under such conditions. These results demonstrate that the condition D/L>3 should be satisfied to reach a spraying angle of equal to or greater than 90°.

INDUSTRIAL APPLICABILITY

The spray button in accordance with the present invention can be used for spraying various contents and is particularly advantageous for spraying contents with a compressed gas spraying agent in a wide range of 80° to 100° in the form of particles with a small diameter. Accordingly, the spray button has high industrial applicability as a spray button for aerosol containers.

EXPLANATION OF REFERENCE SYMBOLS AND NUMERALS

1 spray button
2 spray button body
3 nozzle body
4 protruding portion
6 inflow channel
7 leading hole
8 annular groove
14 nozzle base
15 annular wall
16 liquid passage
17 spray groove
18 connection portion
20 rotation chamber
21 spray orifice
22 dome-shaped depression
23 stem-side sidewall
24 tip surface of spray orifice

The invention claimed is:

1. A spray button made from plastic and suitable for an aerosol container using compressed gas as a spraying agent, the spray button comprising:

a rotation chamber;

a spray orifice; and a plurality of spray grooves, wherein when a diameter of the rotation chamber is denoted by D, a diameter of the spray orifice is denoted by Da, a width of a connection portion of each of the spray grooves and the rotation chamber is denoted by Dd, and a length from a stem-side sidewall of a nozzle body to a tip of the spray orifice is denoted by L, the following relationships are satisfied;

(i) $D/Da>1$;

(ii) $D/Dd\geq5$; and (iii) $D/L\geq3$, (iv) wherein the length L from the stem-side sidewall of the rotation chamber to the tip of the spray orifice is equal to or less than 0.6 mm, (v) wherein a land length La of the spray orifice is equal to or greater than 0.1 mm and less than 0.3 mm, (vi) wherein the diameter D of the rotation chamber is 1.5 mm to 3.0 mm.

2. The spray button according to claim 1, wherein the width Dd of the connection portion of each spray groove and the rotation chamber is 0.1 mm to 0.3 mm.

3. The spray button according to claim 1, wherein the number of the spray grooves is equal to or greater than three.

4. The spray button according to claim 2, wherein the plurality of spray grooves is three or more spray grooves.

* * * * *